US006742717B2

(12) United States Patent
Aberegg et al.

(10) Patent No.: US 6,742,717 B2
(45) Date of Patent: Jun. 1, 2004

(54) ACTUATOR CAP FOR RADIALLY LOCATING A CAN IN A HOLDING DEVICE

(75) Inventors: Dale Aberegg, Mount Vernon, OH (US); Cathal L. Fahy, Columbus, OH (US); Steven A. Zach, Racine, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 190 days.

(21) Appl. No.: 10/207,556

(22) Filed: Jul. 29, 2002

(65) Prior Publication Data

US 2003/0052195 A1 Mar. 20, 2003

Related U.S. Application Data

(63) Continuation-in-part of application No. 09/951,413, filed on Sep. 14, 2001.

(51) Int. Cl.[7] ..... B05B 17/00

(52) U.S. Cl. ..... 239/1; 239/337; 239/288.5; 239/532; 239/578; 222/402.13; 222/402.15; 222/174

(58) Field of Search ..... 239/288.5, 337, 239/578, 532, 1; 222/402.1, 402.13, 402.15, 174

(56) References Cited

U.S. PATENT DOCUMENTS

| | | | | | |
|---|---|---|---|---|---|
| 2,653,053 | A | * | 9/1953 | Henchert | 222/402.13 |
| 2,887,273 | A | * | 5/1959 | Anderson et al. | 239/337 |
| 2,893,606 | A | | 7/1959 | Hawkins | |
| 3,185,350 | A | | 5/1965 | Abplanalp et al. | |
| 3,260,416 | A | | 7/1966 | Abplanalp | |
| 3,269,614 | A | | 8/1966 | Abplanalp | |
| 3,313,458 | A | * | 4/1967 | Braun | 239/337 |
| 3,397,822 | A | | 8/1968 | Peters | |
| 3,856,209 | A | | 12/1974 | Hickson | |
| 3,871,557 | A | | 3/1975 | Smrt | |
| 3,887,115 | A | * | 6/1975 | Petterson | 222/402.13 |
| 3,967,763 | A | | 7/1976 | Focht | |
| 4,092,000 | A | | 5/1978 | Offutt, III | |
| 4,248,360 | A | * | 2/1981 | Crump | 239/532 |
| 4,323,196 | A | | 4/1982 | Logue et al. | |
| 4,381,065 | A | | 4/1983 | Hayes | |
| 4,789,084 | A | * | 12/1988 | Yoshitomi | 222/174 |
| 4,886,191 | A | | 12/1989 | Yoshitomi | |
| 5,137,180 | A | * | 8/1992 | Kieras | 239/337 |
| D353,540 | S | | 12/1994 | Hughes | |
| 5,518,148 | A | | 5/1996 | Smrt | |
| 5,775,595 | A | | 7/1998 | Knodel et al. | |
| 5,915,599 | A | * | 6/1999 | Takahashi | 239/288.5 |
| 6,006,957 | A | | 12/1999 | Kunesh | |
| 6,027,042 | A | | 2/2000 | Smith | |
| 6,102,305 | A | | 8/2000 | Chapman et al. | |
| 6,161,736 | A | * | 12/2000 | Kaufman et al. | 222/402.15 |
| 6,280,072 | B1 | | 8/2001 | Poston | |
| 6,318,600 | B1 | * | 11/2001 | Winnett et al. | 222/402.15 |
| 2003/0126709 | A1 | | 7/2003 | Policicchio et al. | |
| 2003/0126710 | A1 | | 7/2003 | Policicchio et al. | |
| 2003/0127108 | A1 | | 7/2003 | Policicchio et al. | |

* cited by examiner

*Primary Examiner*—Steven J. Ganey

(57) ABSTRACT

An actuator cap for use in radially locating a pressurized can in a sprayer device having a cradle for receiving the can. The actuator cap has a recess that engages an engagement land of the cradle and an actuator arm that is so located as to be movable by an actuation pin located in the engagement land. By such movement, the can's valve can be activated and its contents released. A method is also disclosed for activating a pressurized, axially extending can having a forwardly presenting valve while the can is held in pre-determined radial orientation within a sprayer device.

17 Claims, 4 Drawing Sheets

ACTUATOR CAP FOR RADIALLY LOCATING A CAN IN A HOLDING DEVICE

CROSS-REFERENCE TO RELATED APPLICATIONS

This is a continuation-in-part of U.S. Ser. No. 09/951,413, filed Sep. 14, 2001.

STATEMENT REGARDING FEDERALLY SPONSORED RESEARCH OR DEVELOPMENT

Not Applicable

BACKGROUND OF THE INVENTION

The present invention relates to devices for holding and activating aerosol or other cans or containers of pressurized contents. Examples of such devices include holders at the end of extender handles intended to allow a user to active a can via a mechanical linkage while holding it at some distance.

If the can to be used in such a holder is equipped with an actuator cap that is designed to be activated by moving a structure that must be accessed only from one point around the circumference of the cap, it is necessary that the actuator cap always fit in the holder in only one radial orientation. For example, if an actuator arm extends across the actuator cap and is designed to be moved by pressing one end of the arm, the point at which it is to be pressed must be carefully aligned with the mechanical part intended to press it. Similarly, if an actuator cap is designed to deliver a spray pattern directed to one side or in a fan or other specific spray pattern, ensuring the orientation of the pattern also requires a consistent radial orientation of the actuator cap in the holder. Furthermore, if the spray is to be delivered essentially axially with respect to the can, the structures that hold and orient the can must not be allowed to block the spray.

There are a variety of means of holding aerosol or other pressurized cans in holders, but the actuator cap of the invention is intended to address the combined problems of providing structures to aid in retaining a can in a holder, radially orienting the can in a precise way within the holder, allowing it to be activated via specific means, and avoiding interference with a substantially axial spray delivery.

BRIEF SUMMARY OF THE INVENTION

The invention provides an actuator cap for use with a pressurized can, the can being axially extended and having a rear end and a front end, the front end having a forwardly presenting valve. The actuator cap is axially extended relative to the can and is attached to the forward end of the can.

The can is intended to be held in a sprayer device that has a cradle for holding the can, the cradle extending axially between a front and rear end with respect to the can held therein. An example of a suitable sprayer device is described in U.S. patent application Ser. No. 09/951,632, filed Sep. 14, 2001 (if the sprayer device shown therein is somewhat modified by removal of the cleaning attachment located at the sprayer end of that device). The disclosure of this patent application and all other publications referred to herein are incorporated herein by reference as if fully set forth.

The cradle has a cradle stop surface at its front end to limit frontward axial motion of the can and a can clamp for retaining the can against the cradle stop surface. The cradle stop surface further has an engagement land extending rearwardly from the cradle stop surface, with an actuation pin located within the engagement land and selectively moveable by a user to protrude rearwardly therefrom to activate the actuator cap. The engagement land may be a unitary structure, or it may be a combination of two or more structures that, collectively, define the engagement land. The term "actuation pin" is not intended to suggest any particular shape and thus may well not be rod-shaped. Instead, the actuation pin may have any convenient cross-sectional shape so long as it presents a contact point that can interact with the actuator cap.

The actuator cap includes a can attachment structure for attaching the actuator cap to the can's front end. One conventional example of a pressurized can is a common aerosol can. Such cans typically have sides and a top, the can top being attached to the sides at a seam that is called the can chime. Conventional aerosol cans also typically have a central valve, located within a valve cup. The valve cup is attached to the can top at a valve cup rim. It is well known in the art to attach actuator caps to aerosol cans by resilient, snap-on features that grasp either the chime or the valve cup rim. Without limitation, such attachment techniques are examples of can attachment structures appropriate for use with the actuator cap of the invention. Chime attachment is preferred as providing a structure that avoids obstructing the remainder of the actuator cap's interior features.

The actuator cap includes a recess to receive the engagement land to aid in retaining the can in the cradle and in locating the actuator cap in a radially pre-determined orientation with respect to the cradle. The actuator cap also includes a valve activator. The valve activator has an internal passage and engages the valve in sealing relation, the valve activator activating the valve when moved, preferably when moved rearwardly, causing the release of can contents through the internal passage. An actuator arm is so located as to extend rearwardly of and align with the actuation pin when the engagement land is received in the recess, the actuator arm being capable of moving, preferably rearwardly, when a user moves the actuation pin to thereby move the valve activator and activate the valve.

Although it is preferred that the structures of the actuator cap be unitarily formed, for example by conventional injection molding techniques well known in the art, it is also possible to form various of the structures as independent but interacting pieces. For example, it is preferred that the actuator arm be attached to the remainder of the actuator cap via a living hinge. However, a separate actuator arm can be provided and attached to the remainder of the actuator cap via a snapped-together hinge or other means. Similarly, it is preferred to form the valve activator as a unitary part of the actuator arm. However, the valve activator can be a separate part, such as a conventional aerosol actuator button, which is contacted by the actuator arm without being co-molded as a part of the actuator arm.

In a preferred embodiment, when the can's valve has a forwardly extending valve stem, the valve activator comprises a rearwardly open valve socket, the valve socket connecting with the internal passage, which extends forwardly to supply can contents to an exit orifice from which the can contents may be dispensed when the valve is activated. But when the can's valve is a female valve, the valve activator comprises a rearwardly extending tube that engages the valve when the actuator cap is in place on the can, the tube having an internal passage extending forwardly to supply can contents to an exit orifice from which the can contents may be dispensed when the valve is activated.

Preferably, the actuator arm extends transversely with respect to the actuator cap and is attached to the remainder of the actuator cap by a living hinge. While the hinge can be at either end of the actuator arm, the preferred point of attachment is at a point remote from the recess, to gain advantageous leverage. The actuator arm has a forwardly facing surface within the recess that is located behind and preferably adjacent to the rearwardmost extension of the engagement land when the can is held in the cradle to receive the actuation pin when a user moves the actuation pin rearwardly.

In one aspect, a slot extends radially in the actuator cap, outwardly from the recess, providing an unobstructed opening from the side of the actuator cap, communicating with the recess. The actuator arm then can extend transversely with respect to the actuator cap, one end of the actuator arm being adjacent the slot.

Preferably, the recess has inwardly slanting guide surfaces to aid in correctly locating the engagement land in the recess when the actuator cap is in position within the cradle. It is also preferred that the recess be adjacent to one side of the actuator cap, with the exit orifice of the valve activator being on the axis of the cap, thus being located between the recess and the side of the actuator cap opposite to the recess. By this arrangement, it is possible to hold the can by interaction of the recess and the engagement land, both located to one side of the exit orifice, without the necessity of any actuator or cradle structures that would obstruct an axial discharge of can contents from the exit orifice.

The method of the invention is a method for activating a pressurized, axially extending can having a forwardly presenting valve while the can is held in pre-determined radial orientation within a sprayer device that has a cradle for holding the can, the cradle extending axially between a front and rear end with respect to the can held therein, the cradle having a cradle stop surface at its front end to limit frontward axial motion of the can and can clamp for retaining the can against the cradle stop surface, the cradle stop surface further having an engagement land extending rearwardly from the cradle stop surface with an actuation pin located within the engagement land and selectively moveable by a user to protrude rearwardly therefrom. The method includes a first step of providing, mounted on the can's front end, an actuator cap having a recess to receive the engagement land to aid in retaining the can in the cradle and in locating the actuator cap in a radially pre-determined orientation with respect to the cradle; a valve activator having an internal passage ending in an exit orifice, the valve activator engaging the valve in sealing relation and activating the valve when moved rearwardly, causing the release of can contents through the internal passage and out the exit orifice; and an actuator arm so located as to extend rearwardly of and align with the actuation pin when the engagement land is received in the recess, the actuator arm being capable of moving rearwardly when a user moves the actuation pin to move the valve activator and activate the valve. The second step of the method is placing the can in the cradle with the engagement land inserted into the recess and securing the can in the cradle by use of the can clamp. The final step is moving the actuation pin rearwardly to activate the valve.

Preferably, the step of providing an actuator cap mounted on the can's front end includes providing a slot extending radially outward from the recess, forming an unobstructed opening from the side of the actuator cap, communicating with the recess; and providing an actuator arm extending transversely with respect to the actuator cap, one end of the actuator arm being radially aligned with the slot, the actuator arm having a forwardly facing surface within the recess that is located rearwardly of and aligned with the actuation pin when the engagement land is received in the recess.

In another aspect, the pressurized can assembly of the invention is suitable for use in a sprayer device that has a cradle for holding a can, the cradle extending axially between a front and rear end with respect to a can held therein, and having a cradle stop surface at its front end to limit frontward axial motion of the can, the cradle stop surface further having an engagement land extending rearwardly from the cradle stop surface, with an actuation pin located within the engagement land and selectively moveable by a user to protrude rearwardly therefrom. The pressurized can assembly includes a pressurized can having a front end and a rear end, the front end having a forwardly presenting valve. An actuator cap is attached to the front end of the can and has a recess of a size and shape sufficient to receive the engagement land in mating relation. The actuator cap also has a valve activator for engaging the valve in sealing relation, the valve activator having an internal passage communicating with an exit orifice. The valve activator is capable of activating the valve when moved, causing the release of can contents through the internal passage to the exit orifice. The actuator cap also includes an actuator arm so located as to extend rearwardly of and align with the actuation pin when the engagement land is received in the recess, the actuator arm being capable of moving when a user moves the actuation pin to move the valve activator and activate the valve.

DETAILED DESCRIPTION OF THE INVENTION

Figure 1:
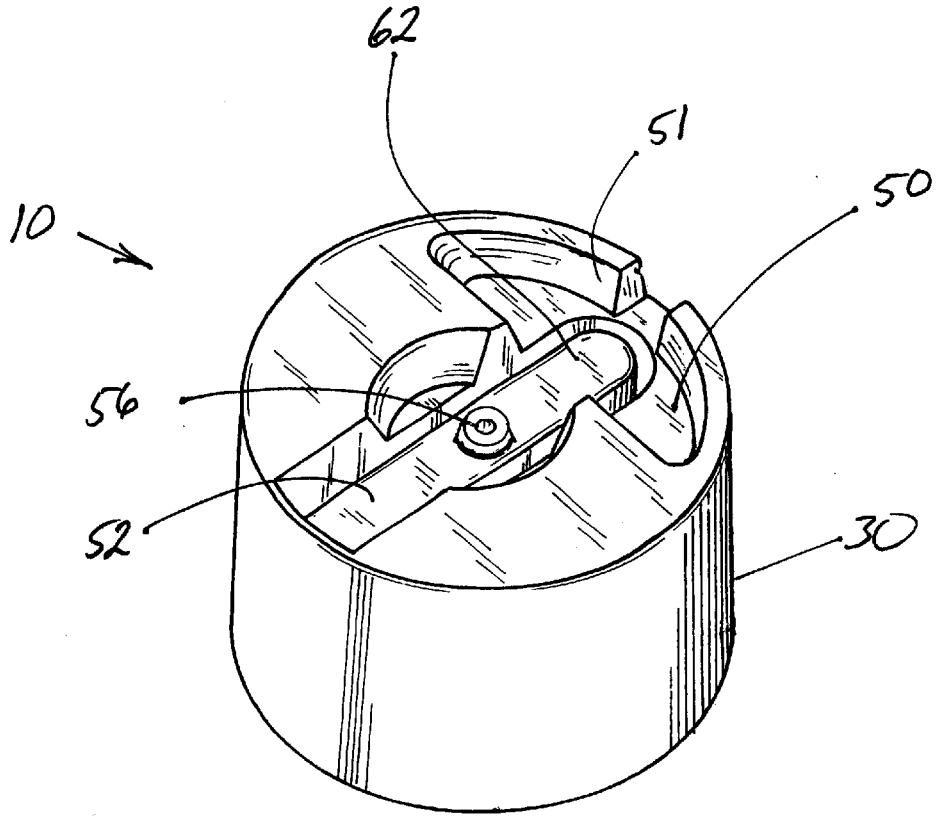
FIG. 1 is a perspective view of an actuator cap of the invention from above.
Figure 2:
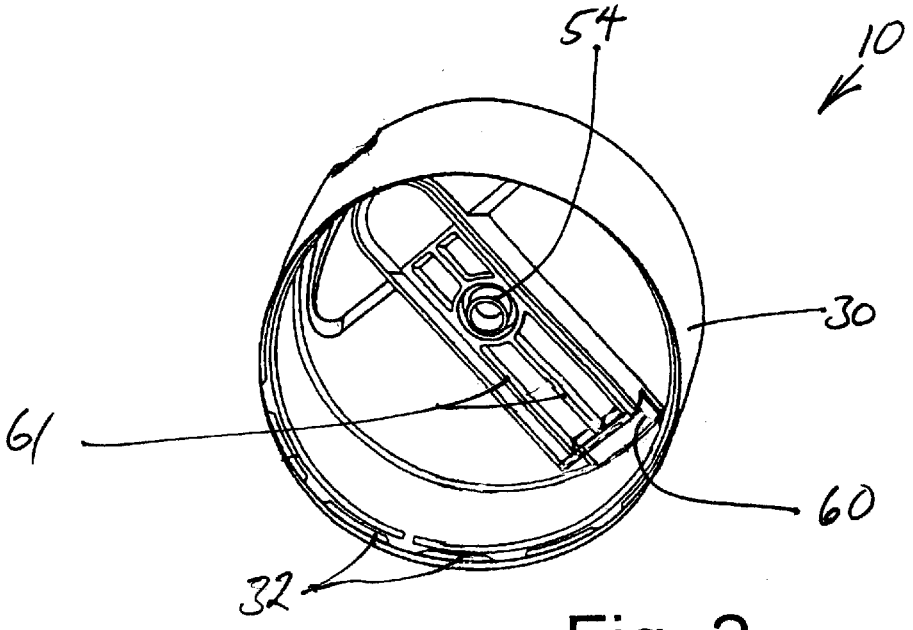
FIG. 2 is a perspective view of an actuator cap of the invention from beneath.
Figure 3:
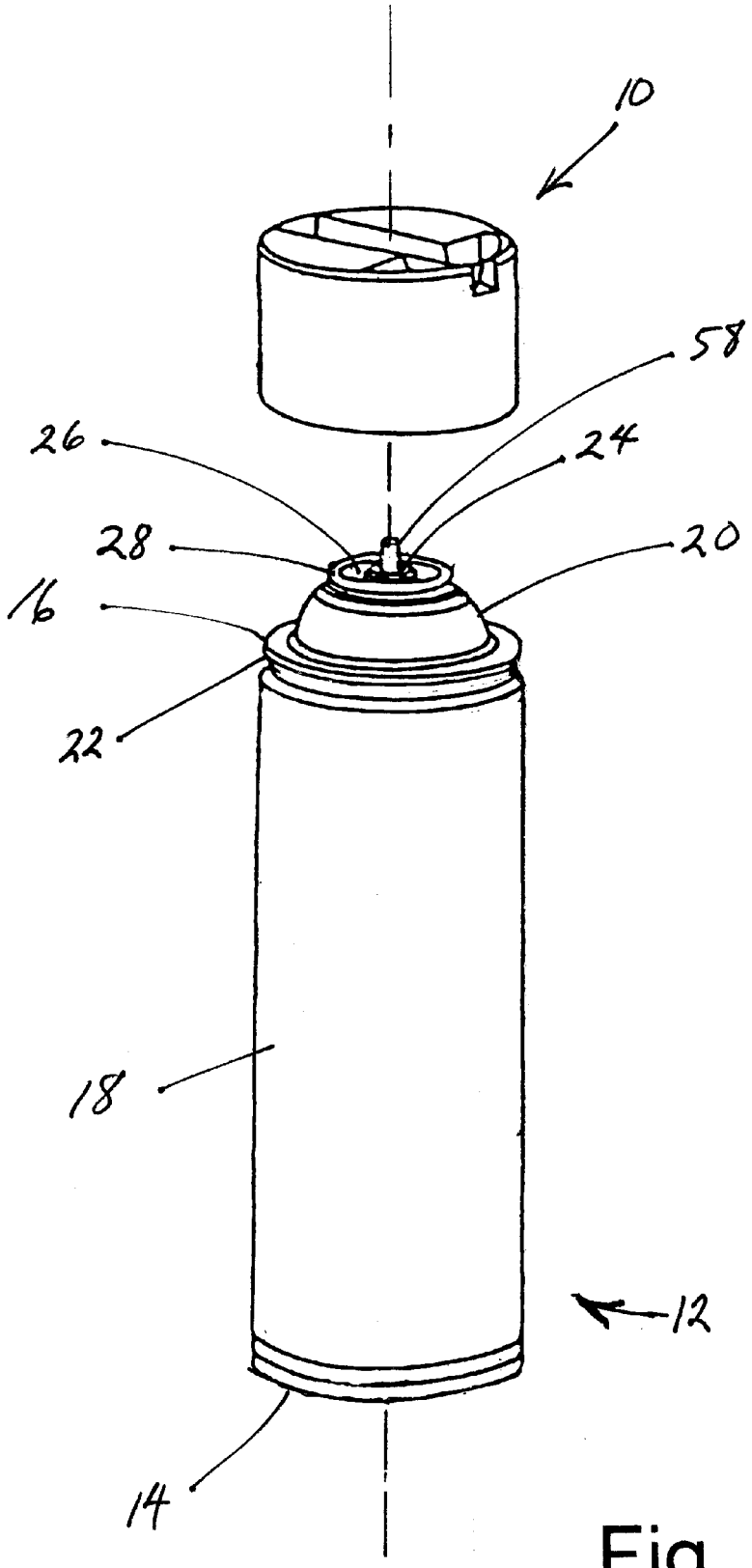
FIG. 3 is a perspective view of a conventional aerosol can with the actuator cap shown in position for attachment.

Turning now to the drawings, wherein like reference numbers refer to like and corresponding parts throughout the several views, an actuator cap for radially locating a can in a holding device is shown from above generally at 10 in FIG. 1 and from beneath in FIG. 2. The actuator cap 10 is adapted for use with a conventional pressurized or aerosol-type can of the kind shown generally at 12 in FIG. 3. The can 12 has a rear end 14 and a front end 16, with sides 18 and a can top 20. The can sides 18 and top 20 are joined together at a seam commonly called the can's chime 22. The can 12 shown also has a valve 24 in a valve cup 26 that is joined to the can top 20 at a seam commonly referred to as the valve cup rim 28.

The actuator cap 10 has a downwardly extending side wall 30 that defines a substantially hollow interior space. Retention detents 32 are formed in the inner surface of the side wall 30 and are sized to resiliently clip over the chime 22, the retention detents thus serving as a can attachment structure for attaching the actuator 10 to the front end 16 of a can. Those skilled in the art will recognize the retention detents 32 to be an example of a number of standard can attachment structures for actuator caps, some attaching at the chime 22, others attaching to the valve cup rim 28 or elsewhere on a can 12, all of which alternatives and their equivalents being included within the breadth and scope of the invention.

Figure 4:
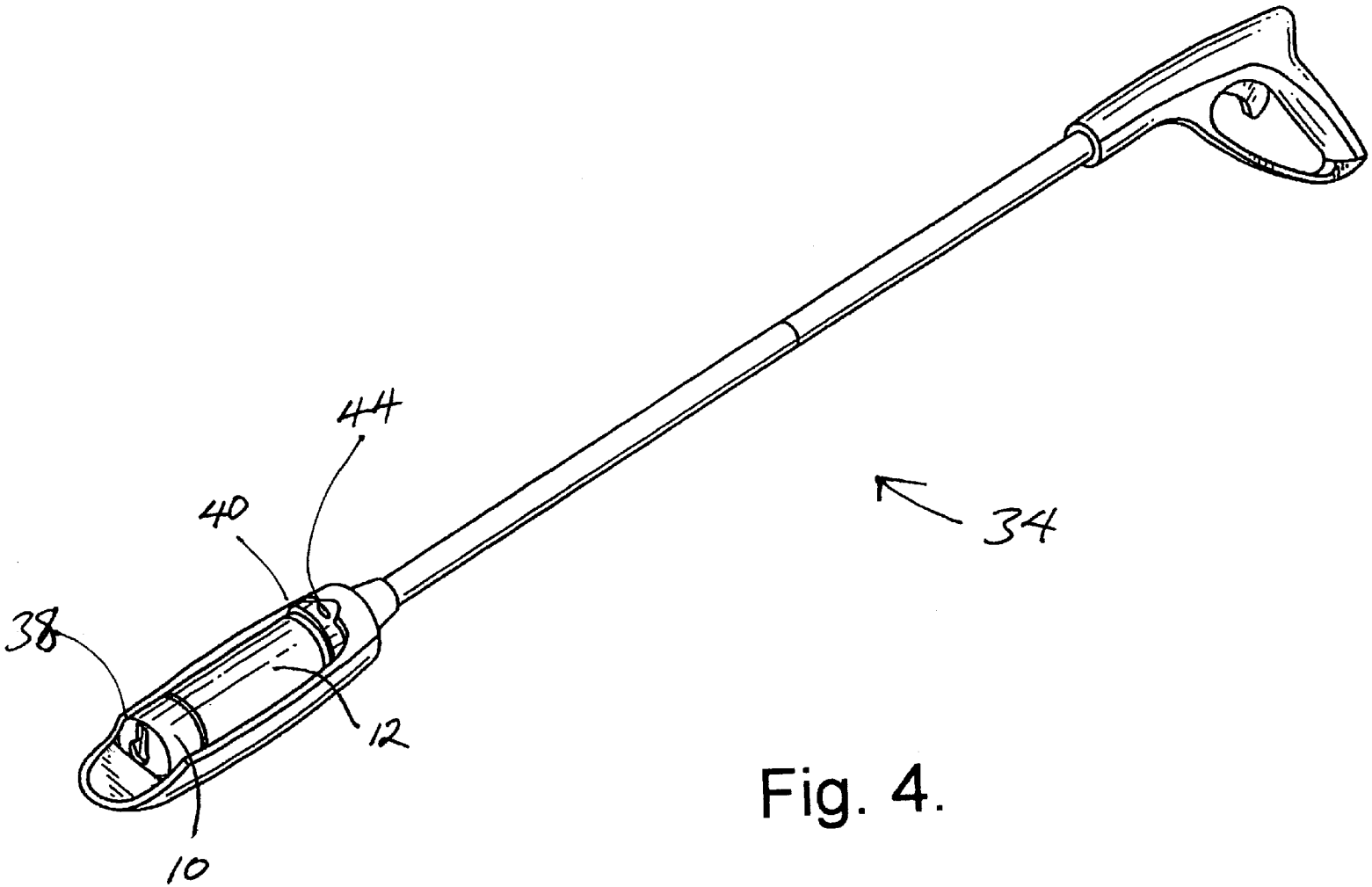
FIG. 4 is a perspective view of a sprayer device for use with the actuator cap of the invention.
Figure 5:
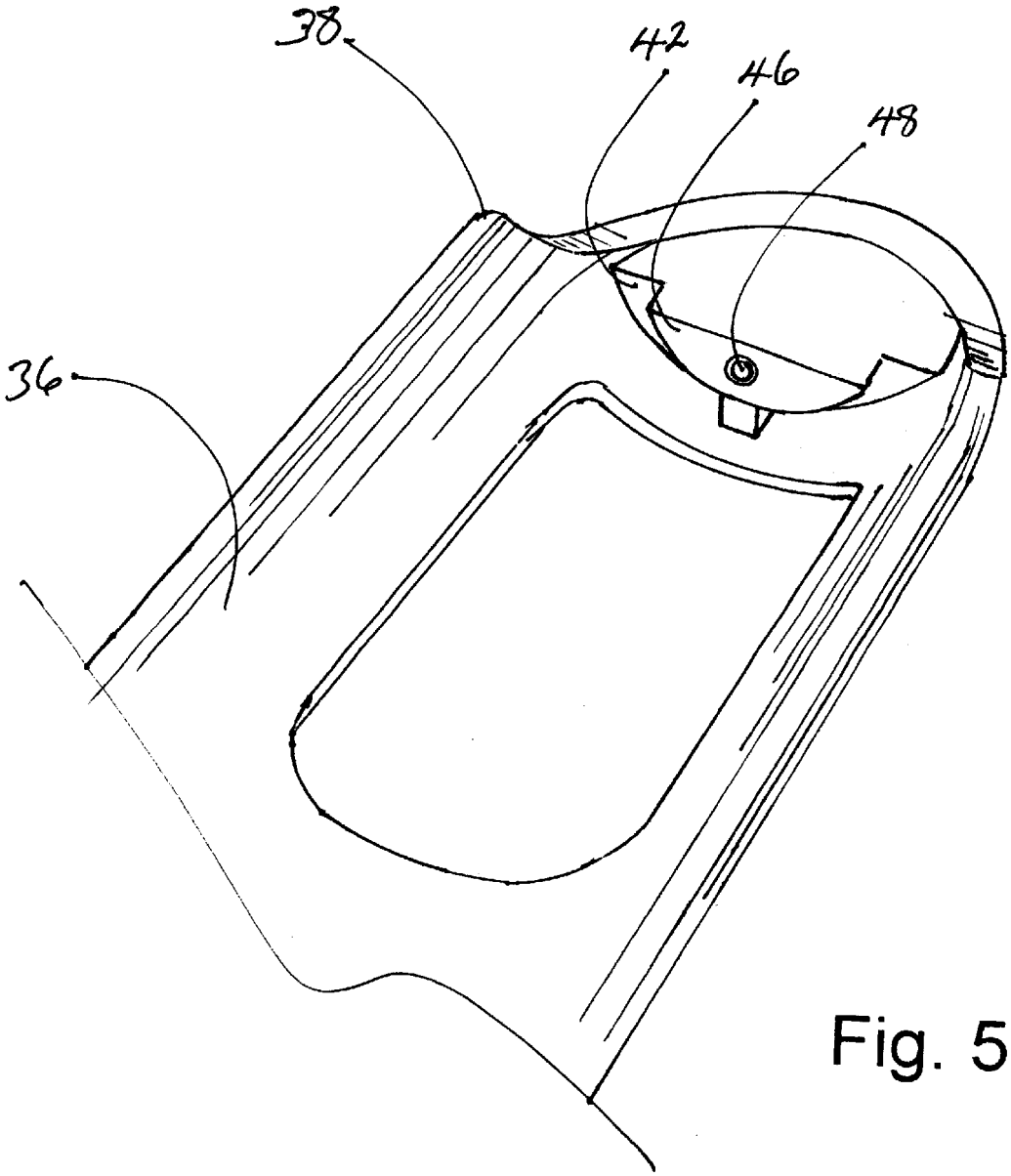
FIG. 5 is a perspective view from above and to the rear of a broken away portion of the cradle of the sprayer device, showing the forward parts of the cradle.

The actuator cap 10 and can 12 are designed to be held in a sprayer device such as that shown generally at 34 in FIG. 4. The sprayer device 34 allows remote activation of a pressurized can and is merely an example of a sprayer device, of course, other sprayer devices being possible with varying purposes and features. The sprayer device 34, as can be seen in FIG. 5, has a cradle 36 for holding the can, the cradle extending axially between the cradle's front end 38 and rear end 40. The cradle 36 has a cradle stop surface 42 at its front end 38 to limit frontward axial motion of the can 12. The cradle 36 also has a can clamp 44 for retaining the can 12 against the cradle stop surface 42. An engagement land 46 extends rearwardly from the cradle stop surface 42, with an actuation pin 48 located within the engagement land and selectively moveable by a user to protrude rearwardly therefrom to activate the actuator cap 10, as described, below.

The actuator cap 10 has a forwardly facing recess 50 sized and shaped to receive the engagement land 46 in radially substantially unmoving relation. Once the can is in place in the cradle 36, the recess 50 preferably at least partially encloses the engagement land 46, thus resisting the sideways removal of the can 12. This aids in retaining the can 12 in the cradle 35 and also serves to locate the actuator cap 10 in a radially pre-determined orientation with respect to the cradle. It is preferred that the recess 50 have inwardly slanting guide surfaces 51 to aid in locating the engagement land 46 in the recess when the actuator cap 10 is placed in position within the cradle 36.

The actuator cap 10 has an actuator arm 52 that extends rearwardly of and is aligned with the actuation pin 48 when the engagement land 46 is received in the recess 50. An end of the actuator arm 52 is joined to the remainder of the actuator cap 10 in hinged relation so that the actuator arm can move when a user moves the actuation pin 48. The actuator cap 10 includes a valve activator 54 capable of engaging the valve 24 in sealing relation. Preferably the valve activator 54 is unitarily formed with the actuator arm 52, as is illustrated in the Figures, although the valve activator may alternatively be formed as a separate piece. The valve activator 54 has an internal passage (not shown) ending in an exit orifice 56.

When the valve activator 54 is moved, by action of the actuation pin 48, the valve activator engages and activates the valve 24, causing the release of can contents through the internal passage and out the exit orifice 56. Preferably, the valve 24 activates by rearward movement of the valve activator 54, but a valve that activates by being tipped to one side is also possible, both types of valves being commonly available and it being possible to achieve either motion in the valve activator by selection of the point of hinge location and other conventional means well known to those skilled in the art. Preferably the valve 24 is a male valve having a valve stem 58 that extends forwardly and axially to be engaged by the valve activator 54. However, female valves are also well known in the art and can be used alternatively, with structures appropriate to activate such a valve being included in the valve activator 54.

Preferably, the actuator arm 52 extends transversely with respect to the actuator cap 10 and is attached to the remainder of the actuator cap by a living hinge 60 at a point remote from the recess 50. While hinged attachment elsewhere is also possible, the preferred attachment provides convenient leverage for activating a centrally located valve 24. In the preferred embodiment, ribs such as the ribs shown at 61 in FIG. 2, are formed in the under side of the actuator arm 52 to stiffen it.

The actuator arm 52 has a forwardly facing surface 62 located within the recess 50, preferably rearward to the rearwardmost extension of the engagement land 46 when the can 12 is held in the cradle 36 and in any event rearward of the actuation pin 48 before the actuation pin is moved, the forwardly facing surface 62 receiving the actuation pin when a user moves the actuation pin rearwardly. It is preferred that the recess 50 be located adjacent to one side of the actuator cap 10 and the valve activator 54 be on the axis of the cap, thus located between the recess and the side of the actuator cap opposite to the recess. This arrangement allows the actuator cap 10 to be held in the cradle 35 without the need for any cradle parts to block the discharge of can contents from the exit orifice 56 of the valve activator 54.

To even more securely radially position the actuator cap 10 within the cradle 36, a secondary land 65 can be provided, extending rearwardly from the cradle stop surface 42. Preferably the secondary land 65 extends radially outwardly from the engagement land 46 at a point opposite the actuation pin 48. The actuator cap 10 then includes a slot 66 that extends radially outward from the recess 50, communicating with the recess and sized so as to engage the secondary land 65 in mating relation when the actuator cap 10 and can 12 are in place within the cradle 36. The actuator arm 52 then preferably extends transversely across the actuator cap 10, with one end of the actuator arm being adjacent the slot 66.

The actuator cap 10 of the invention can be manufactured by injection molding from plastics conventionally used for aerosol actuator caps. The practical methods of use of the actuator cap 10 are described, above.

The preceding description is merely of preferred embodiments of the invention. One skilled in the art will readily apprehend alternative embodiments that nevertheless fall within the scope and breadth of the invention. Thus, the claims should be looked to in order to understand the full scope of the invention.

INDUSTRIAL APPLICABILITY

An actuator cap, together with the means for its manufacture and use, is disclosed for practical application in the described use circumstance.

What is claimed is:

1. An actuator cap for use with a pressurized can, the can having a rear end and a front end, the front end having a forwardly presenting valve, the can being holdable in a sprayer device that has a cradle for holding a can, the cradle extending axially between a front and rear end with respect to a can held therein, and having a cradle stop surface at its front end to limit frontward axial motion of the can, the cradle stop surface further having an engagement land extending rearwardly from the cradle stop surface, with an actuation pin located within the engagement land and selectively moveable by a user to protrude rearwardly therefrom to activate the actuator cap, the actuator cap being axially extended relative to the can and comprising:

a. a can attachment structure for attaching the actuator cap to the can's front end;

b. a recess of a size and shape sufficient to receive the engagement land in mating relation;

c. a valve activator for engaging the valve in sealing relation and having an internal passage communicating with an exit orifice, the valve activator activating the valve when moved, causing the release of can contents through the internal passage to the exit orifice;

d. an actuator arm so located as to extend rearwardly of and align with the actuation pin when the engagement land is received in the recess, the actuator arm being capable of moving when a user moves the actuation pin to move the valve activator and activate the valve.

2. The actuator cap of claim 1 wherein the can's valve has a forwardly extending valve stem and the valve activator comprises a rearwardly open valve socket, the valve socket communicating with the internal passage.

3. The actuator cap of claim 1 wherein the valve activator is unitarily formed with the actuator arm.

4. The actuator cap of claim 1 wherein the actuator arm extends transversely with respect to the actuator cap and is attached to the remainder of the actuator cap by a living hinge.

5. The actuator cap of claim 1 wherein the actuator arm extends transversely with respect to the actuator cap and is attached to the remainder of the actuator cap by a living hinge at a point remote from the recess.

6. The actuator cap of claim 1 wherein the actuator arm has a forwardly facing surface located within the recess, the forwardly facing surface being located rearward to the rearwardmost extension of the engagement land when the can is held in the cradle to receive the actuation pin when a user moves the actuation pin rearwardly.

7. The actuator cap of claim 1 wherein a slot extends radially outward from the recess, providing an unobstructed opening from the side of the actuator cap, communicating with the recess.

8. The actuator cap of claim 7 wherein the actuator arm extends transversely with respect to the actuator cap, one end of the actuator arm being adjacent the slot.

9. The actuator cap of claim 1 wherein the actuator cap is designed for use with a can having a can chime, and the can attachment structure for attaching the actuator cap to the can's front end attaches to the can chime.

10. The actuator cap of claim 1 wherein the actuator cap is designed for use with a can having a valve cup rim, and the can attachment structure for attaching the actuator cap to the can's front end attaches to the valve cup rim.

11. The actuator cap of claim 1 wherein the recess has inwardly slanting guide surfaces to aid in locating the engagement land in the recess when the actuator cap is in position within the cradle.

12. The actuator cap of claim 1 wherein the recess is adjacent to one side of the actuator cap and the valve activator is on the axis of the cap, thus located between the recess and the side of the actuator opposite to the recess.

13. An actuator cap for use with a pressurized can, the can having a rear end and a front end, the front end having a forwardly presenting valve, the can being holdable in a sprayer device that has a cradle for holding the can, the cradle extending axially between a front and rear end with respect to the can held therein, and having a cradle stop surface at its front end to limit frontward axial motion of the can, the cradle stop surface further having an engagement land extending rearwardly from the cradle stop surface with an actuation pin located within the engagement land and selectively moveable by a user to protrude rearwardly therefrom to activate the actuator cap, the actuator cap being axially extended relative to the can and comprising:

a. a can attachment structure for attaching the actuator cap to the can's front end;

b. a recess to receive the engagement land to aid in retaining the can in the cradle and in locating the actuator cap in a radially pre-determined orientation with respect to the cradle;

c. a slot extending radially outward from the recess providing an unobstructed opening from the side of the actuator cap, communicating with the recess;

d. a valve activator for engaging the valve in sealing relation, the valve activator activating the valve when moved rearwardly, causing the release of can contents;

e. an actuator arm extending transversely with respect to the actuator cap, one end of the actuator arm being radially aligned with the slot, the actuator arm having a forwardly facing surface within the recess that is located rearwardly of and aligned with the actuation pin when the engagement land is received in the recess, the actuator arm being capable of moving rearwardly when a user moves the actuation pin to contact the forwardly facing surface to move the valve activator and activate the valve.

14. The actuator cap of claim 13 wherein the valve activator is unitarily formed with the actuator arm, and the actuator arm is attached to the remainder of the actuator cap by a living hinge at a point remote from the recess.

15. A method for activating a pressurized, axially extending can having a forwardly presenting valve while the can is held in pre-determined radial orientation within a sprayer device that has a cradle for holding the can, the cradle extending axially between a front and rear end with respect to the can held therein, the cradle having a cradle stop surface at its front end to limit frontward axial motion of the can and a can clamp for retaining the can against the cradle stop surface, the cradle stop surface further having an engagement land extending rearwardly from the cradle stop surface with an actuation pin located within the engagement land and selectively moveable by a user to protrude rearwardly therefrom, the method comprising the steps of:

a. providing, mounted on the can's front end, an actuator cap having i. a recess to receive the engagement land to aid in retaining the can in the cradle and in locating the actuator cap in a radially pre-determined orientation with respect to the cradle;

ii. a valve activator for engaging the valve in sealing relation, the valve activator activating the valve when moved rearwardly, causing the release of can contents;

iii. an actuator arm so located as to extend rearwardly of and align with the actuation pin when the engagement land is received in the recess, the actuator arm being capable of moving rearwardly when a user moves the actuation pin to move the valve activator and activate the valve;

b. placing the can in the cradle, with the engagement land inserted into the recess and securing the can in the cradle by use of the can clamp; and c. moving the actuation pin rearwardly to activate the valve.

16. The method of claim 15 wherein the step of providing an actuator cap mounted on the can's front end includes providing:

a. a slot extending radially outward from the recess, forming an unobstructed opening from the side of the actuator cap, communicating with the recess;

b. an actuator arm extending transversely with respect to the actuator cap, one end of the actuator arm being radially aligned with the slot, the actuator arm having a forwardly facing surface within the recess that is located rearwardly of and aligned with the actuation pin when the engagement land is received in the recess.

17. A pressurized can assembly suitable for use in a sprayer device that has a cradle for holding a can, the cradle extending axially between a front and rear end with respect to a can held therein, and having a cradle stop surface at its front end to limit frontward axial motion of the can, the cradle stop surface further having an engagement land extending rearwardly from the cradle stop surface, with an actuation pin located within the engagement land and selectively moveable by a user to protrude rearwardly therefrom, the pressurized can assembly comprising:

a. a pressurized can having a front end and a rear end, the front end having a forwardly presenting valve;

b. an actuator cap attached to the front end of the can and having i. a recess of a size and shape sufficient to receive the engagement land in mating relation;

ii. a valve activator for engaging the valve in sealing relation and having an internal passage communicating with an exit orifice, the valve activator activating the valve when moved, causing the release of can contents through the internal passage to the exit orifice; and iii. an actuator arm so located as to extend rearwardly of and align with the actuation pin when the engagement land is received in the recess, the actuator arm being capable of moving when a user moves the actuation pin to move the valve activator and activate the valve.

* * * * *